United States Patent [19]

Hofmann

[11] Patent Number: 4,605,325

[45] Date of Patent: Aug. 12, 1986

[54] RIBBON CASSETTE WITH RELEASABLE LOCKING MECHANISM

[75] Inventor: Norbert Hofmann, Nuremberg, Fed. Rep. of Germany

[73] Assignee: Triumph Adler AG, Nuremberg, Fed. Rep. of Germany

[21] Appl. No.: 738,175

[22] Filed: May 28, 1985

[30] Foreign Application Priority Data

Jun. 8, 1984 [DE] Fed. Rep. of Germany ..... 3421407

[51] Int. Cl.[4] ..... B41J 35/28

[52] U.S. Cl. ..... 400/207; 400/208

[58] Field of Search ..... 242/198; 400/196, 207, 400/208

[56] References Cited

U.S. PATENT DOCUMENTS

| | | | |
|---|---|---|---|
| 3,294,228 | 12/1966 | Urso et al. | 400/208 |
| 3,464,533 | 9/1969 | Gallant | 400/208 |
| 3,706,426 | 12/1972 | Prahl | 242/198 |
| 3,934,839 | 1/1976 | Serizawa | 242/198 |
| 4,210,296 | 7/1980 | Frechette | 400/208 X |
| 4,272,202 | 6/1981 | Schroeder et al. | 400/208 |
| 4,413,919 | 11/1983 | Applegate et al. | 400/208 |
| 4,449,676 | 5/1984 | Ogata et al. | 242/198 |
| 4,500,050 | 2/1985 | Oishi et al. | 242/198 |

*Primary Examiner*—Edgar S. Burr
*Assistant Examiner*—John A. Weresh
*Attorney, Agent, or Firm*—Joseph R. Spalla

[57] ABSTRACT

A ribbon cassette incorporates a locking mechanism which acts to prevent both rotational spool movement and axial displacement or "treeing" of the coils of ribbon wound on a single flange supply spool prior to mounting for use in a typewriter. The locking mechanism is automatically released when the cassette is mounted for use in a typewriter or like machine.

4 Claims, 3 Drawing Figures

RIBBON CASSETTE WITH RELEASABLE LOCKING MECHANISM

This invention relates to ribbon cassettes for typewriters or like machines; more particularly, it relates to ribbon cassettes for typewriters or like machines having releaseable locking mechanism for preventing axial displacement of coils of ribbon wound on a single flange supply spool as well as rotational movement of the supply spool prior to mounting the cassette on the machine for use.

In ribbon cassettes which support a single flange supply spool from which ribbon is drawn off for movement past a printing point and taken up on a moveable take-up spool it is desirable that, during handling prior to use, the coil of ribbon wound on the supply spool be prevented from axial displacement, resulting in the coil taking a conical shape, sometimes known as "treeing" of the coil, as would cause it to interfere with the cover of the cassette and impose undue loads on the take-up mechanism. A further consideration is that the supply spool, prior to use, be prevented from rotation as would allow ribbon to be pulled off therefrom resulting in overlong, unmanageable external loops requiring manual take-up before the cassette can be inserted in a typewriter.

German Utility Model No. 80 32 607 discloses a solution to the treeing problem in the use of a removeable slide normally overlying the supply ribbon coil. If one forgets to remove the slide before mounting in the machine, improper take-up of ribbon will result due to frictional forces imposed by the slide which cannot be readily overcome by the ribbon drive.

U.S. Pat. No. 4,413,919 discloses a generally circular cassette provided with a spool anti-rotation device which is made inoperative only by turning the cassette through a predetermined angle as it is being mounted. This expedient is not readily possible with cassettes of generally rectangular configuration.

In accordance with the invention, a spring biased locking plate within the cassette is normally pressed against the coil of ribbon on the supply spool to prevent treeing of the ribbon coil during transportation and handling prior to use. When the cassette is mounted on the machine, a machine part acts against the locking plate to move it away from the ribbon coil. A feature of the invention also resides in means on the locking plate and supply spool core for preventing rotation of the supply spool during transportation and handling prior to mounting the cassette in the typewriter or like machine.

An object of the invention is in the provision of a ribbon cassette in which treeing of the coil of ribbon is prevented during transport and handling.

Another object of the invention is to provide a mechanism within a ribbon cassette which is normally operative until the cassette is mounted in a typewriter to preclude supply spool rotation and treeing of the coil of ribbon on the supply spool.

Another object of the invention is to provide a normally operative anti-rotation, anti-treeing device in a ribbon cassette which is rendered inoperative when the cassette is mounted in the typewriter or like machine.

A further object of the invention is in the provision of a ribbon cassette including a supply spool locking device which can be implemented without significant increase in the cost of the cassette and which does not require operator attention.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
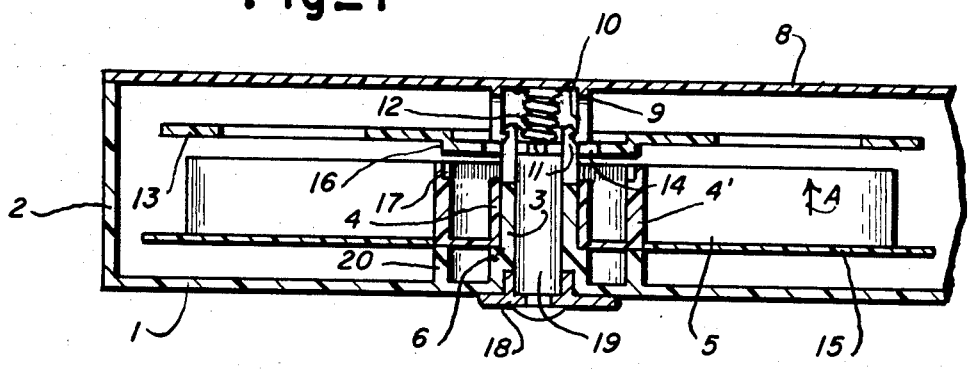
FIG. 1 is a partial cross-sectional view taken through a mounted ribbon cassette in the supply spool region showing the locking mechanism of the invention in inoperative position.
Figure 3:
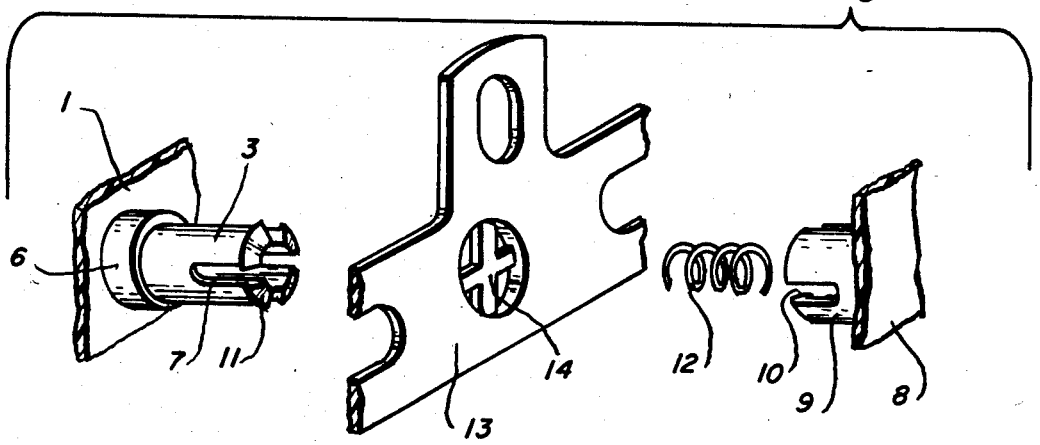
FIG. 3 is a partial perspective view showing details of the parts shown in FIGS. 1 and 2.

Referring now to the drawing wherein like parts are designated by like or corresponding reference numerals or characters, there is shown in FIG. 1 a ribbon cassette comprising a bottom wall 1 with integrally formed side walls 2. Upstanding from the bottom wall 1 is a hollow axle 3 formed as shown in FIG. 3 which serves to rotatably support a single flange ribbon supply spool having a core with an inner wall 4 and an outer longer wall 4' extending upwardly from the single flange 15 of the supply spool. A coil of ribbon 5 is wound about the outer wall 4' of the core and is supported by the flange 15. As shown in FIGS. 1 and 3, the upper edge of a collar 6 formed on the hollow axle 3 serves to rotatably support the inner wall 4 of the supply spool core above the bottom wall 1 of the cassette. As shown in FIG. 3 the upper end of the hollow axle 3 is formed with cross slits 7 so that during assembly the bevelled ends of the axle 3 may deflect radially inwardly when a complimentary structure on the cover of the cassette is mounted and secured to the side walls 2 of the cassette. As shown in FIG. 3, the complementary structure on the cover 8 includes a downwardly depending slitted collar 9 having at the ends inwardly turned hooks 10 for engagement behind outwardly turned hooks 11 on the upper end of the spool axle 3. The structure prevents upward arching of the cover 8 of the cassette under the action of a spring 12 located within the collar 9 and whose function will be described hereinafter.

In the assembly of the cassette, after the supply spool core with the ribbon coil 5 wound thereon has been placed on the axle 3, a locking plate 13 is placed over the axle 3 and rests on the ribbon coil 5. In the embodiment shown, the locking plate 13 is provided with three arms extending radially outwardly from a recessed cross shaped central portion 14. It is to be understood, however, that arms of the lock part 13 can take other shapes as dictated by the parts of a cassette. The only essential is that the arms of the lock part 13 cover a sufficiently large portion of the ribbon coil to prevent axial displacement thereof.

Figure 2:
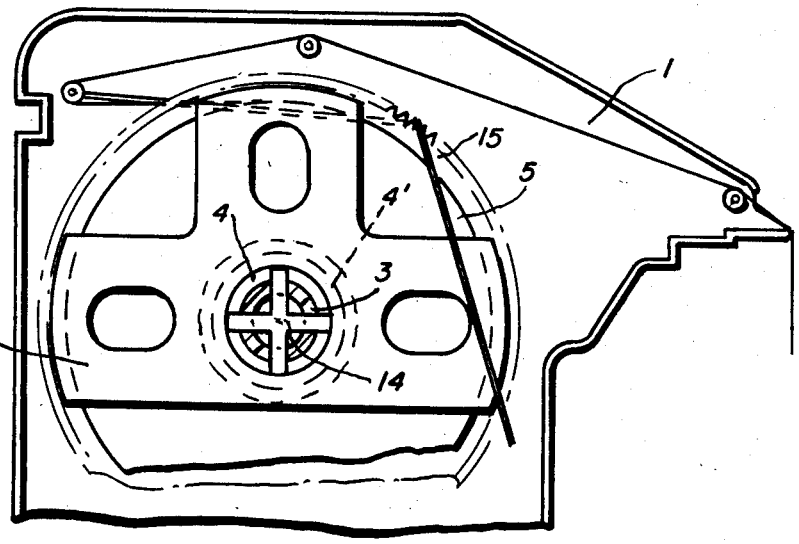
FIG. 2 is a partial plan view of the cassette shown in FIG. 1 with the cassette cover removed.

As shown in FIGS. 2 and 3, the opening in the cross shaped recessed central portion 14 of the locking plate 13 accommodate the split ends of the axle 3 with the slits 7 therein embracing the arms of the cross shaped central portion 14. This arrangement prevents turning of the locking plate 13 relative to the cassette. After the locking plate 13 is assembled onto the axle 13, the spring 12 is mounted within the hollow end of the axle 3 and rests on the cross piece 14 of the locking plate 13. Thus, the cover 8 of the cassette is mounted with the collar 9 surrounding the spring 12 and pressed to effect engagement of hooks 10 on the collar 9 and hooks 11 on the upper end of the axle 3 thereby compressing spring 12 between cover 8 and the locking plate 13, urging the later against the ribbon coil 5 and in turn the flange 15 of the spool carrying the ribbon coil 5 against the upper edge of the collar 6 on the axle 3 and against an upstanding circular abutment 20 extending upwardly from the bottom wall 1 outwardly of axle 3. This structures prevents axial displacement of the ribbon coil 5 in direction A even in the case of strong shaking during transport and handling prior to use.

As hereinbefore noted, FIG. 1 shows the cassette mounted in a typewriter or like machine which includes a plate 18 which may be part of a print head supporting carriage. Upstanding from the plate 18 is a pin 19 which when the cassette is pushed down toward the plate 18, and latched to the plate 18 in a known manner, the pin 19 will encounter the cross-shaped central portion 14 of the locking plate 13 forcing it upward against the action of spring 12 and away from the ribbon coil as shown in FIG. 1 thereby removing vertical forces acting on the ribbon coil allowing the supply spool to rotate freely.

With further reference to FIG. 1, the lower edges 16 of the recessed cross shaped central portion 14 of the locking plate 13 are provided with serrations 16 for engagement with counter serrations 17 on the inner edge of the outer wall 4' of the spool coil when the locking plate 13 is in locked position to prevent spool rotation relative to the cassette. When the locking plate 13 is raised to the inoperative position shown in FIG. 1, the serrations 16 and 17 also disengage freeing the spool for rotation.

When the cassette is removed, the locking plate 13 under the action of spring 12, will again engage the ribbon coil and bring serrations 16 and 17 into engagement also.

The invention claimed is:

1. A ribbon cassette for use in typewriters or like machines, said cassette having a bottom wall and a cover and containing a single flange ribbon supply spool supporting a ribbon coil, a hollow axle extending from the bottom wall toward said cover for rotatably supporting said ribbon supply spool and for accommodating a pin extending upwardly from a cassette supporting machine part, a locking plate having a dimension at least equal to the diameter of a full ribbon coil non-rotatably mounted on said moveable relative to said axle in planes parallel to the plane of said ribbon coil, means on said axle and said cover for locking said cover to said axle, and a coiled spring positioned between said cover and said locking plate with its coil axis aligned with the axis of said axle for normally biasing said locking plate against the plane of said ribbon coil to prevent treeing of said ribbon coil, said plate being moveable away from said ribbon coil against the bias of said spring by said pin when said cassette is mounted on said machine part, said non-rotatable mounting of said locking plate and said axle comprising a central cross shaped portion on said locking plate, and an axially slitted upper end on said axle to accommodate its extension through said openings on said cross-shaped portion whereby relative rotational movement is precluded while axial movement of said locking plate relative to said axle is permitted.

2. A ribbon cassette as recited in claim 1, said locking plate and said ribbon supply spool having complementary surfaces engageable when said cassette is not mounted on said typewriter to prevent rotation of said ribbon supply spool.

3. A ribbon cassette as recited in claim 2, said complementary surfaces comprising serrations on said locking plate and the spool core.

4. A ribbon cassette as recited in claim 1, said means on said axle and said cover for locking said cover to said axle comprising bevelled hooks on the slitted upper end of said axle, and an axially slitted collar depending from said cover having bevelled hooks on its end directed oppositely to the bevelled hooks on said axle to lockingly engage one another, said coiled spring between said cover and locking plate being located within said collar.

* * * * *

UNITED STATES PATENT AND TRADEMARK OFFICE

CERTIFICATE OF CORRECTION

PATENT NO. : 4,605,325

DATED : August 12, 1986

INVENTOR(S) : Norbert Hofmann

It is certified that error appears in the above-identified patent and that said Letters Patent are hereby corrected as shown below:

Claim 1 at column 4, line 6, after "said" (first occurrence) insert----axle overlying the plane of said ribbon coil and axially----.

Signed and Sealed this

Fourteenth Day of October, 1986

[SEAL]

*Attest:*

DONALD J. QUIGG

*Attesting Officer*

*Commissioner of Patents and Trademarks*